US010066909B2

(12) United States Patent
Moberg

(10) Patent No.: US 10,066,909 B2
(45) Date of Patent: Sep. 4, 2018

(54) LEACHING PROTECTOR FOR OUTDOOR SHOOTING RANGES

(71) Applicant: Stapp International AB, Eskilstuna (SE)

(72) Inventor: Gerth Moberg, Eskilstuna (SE)

(73) Assignee: STAPP INTERNATIONAL AB, Eskilstuna (SE)

( * ) Notice: Subject to any disclaimer, the term of this patent is extended or adjusted under 35 U.S.C. 154(b) by 0 days.

(21) Appl. No.: 14/404,921

(22) PCT Filed: May 31, 2013

(86) PCT No.: PCT/SE2013/050638

§ 371 (c)(1),
(2) Date: Dec. 1, 2014

(87) PCT Pub. No.: WO2013/184062

PCT Pub. Date: Dec. 12, 2013

(65) Prior Publication Data

US 2015/0123347 A1 May 7, 2015

(30) Foreign Application Priority Data

Jun. 4, 2012 (SE) ..... 1250579

(51) Int. Cl.
*F41J 13/00* (2009.01)

(52) U.S. Cl.
CPC ..... *F41J 13/00* (2013.01)

(58) Field of Classification Search
CPC ..... F41J 13/00; B29C 66/1122; E04D 3/365
(Continued)

(56) References Cited

U.S. PATENT DOCUMENTS 579,948 A 4/1897 Brooks
4,728,109 A 3/1988 Simonelli
(Continued)

FOREIGN PATENT DOCUMENTS

DE 4317742 A1 12/1994
DE 4441559 A1 5/1996
(Continued)

OTHER PUBLICATIONS

LINATEX Rubber Products, Linard 60, Weir Minerals, http://www.weirminerals.com/products_services/rubber/the_linard_range/linard_60.aspx, captured Jan. 8, 2011.*
(Continued)

*Primary Examiner* — Melba Bumgarner
*Assistant Examiner* — Laura L Davison
(74) *Attorney, Agent, or Firm* — Knobbe, Martens, Olson & Bear, LLP

(57) ABSTRACT

The object of the present invention is to provide a leaching protector at outdoor shooting ranges comprising an elastic covering layer arrangement (100), a projectile-arresting material and a drainage arrangement. The covering layer arrangement (100) comprises a security layer (101) covering a security area (110) having a low probability of being penetrated by projectiles and a firing layer (102) covering a firing area (120) having a high probability of being penetrated by projectiles. The security layer (101) and the firing layer (102) are penetrable by projectiles. The security layer (101) is made of a first material and the firing layer (102) is made of a second material.

21 Claims, 6 Drawing Sheets

(58) Field of Classification Search
USPC .... 273/403, 404, 410; 160/87, 89, 113, 130, 160/179, 181, 182, 184, 215, 379; 52/3–5, 518, 520, 521, 529, 542–55, 568, 52/748.1, 748.112
See application file for complete search history.

(56) References Cited

U.S. PATENT DOCUMENTS

| | | | | | |
|---|---|---|---|---|---|
| 4,741,132 | A * | 5/1988 | Emblin | E04D 3/38 52/404.3 |
| 4,773,653 | A * | 9/1988 | Unverzagt | F41J 13/00 273/404 |
| 4,786,059 | A * | 11/1988 | Barini | F41J 13/00 273/403 |
| 5,799,948 | A | 9/1998 | Moberg | |
| 5,848,794 | A * | 12/1998 | Wojcinski | F41J 13/00 273/404 |
| 6,715,761 | B1 | 4/2004 | Moberg | |
| 7,134,664 | B2 | 11/2006 | Tom et al. | |
| 7,185,892 | B2 * | 3/2007 | Moberg | F41J 13/00 273/410 |
| 2004/0239037 | A1 | 12/2004 | Tom et al. | |
| 2011/0233869 | A1 * | 9/2011 | John | F41H 5/013 273/410 |
| 2011/0233870 | A1 | 9/2011 | Oh et al. | |

FOREIGN PATENT DOCUMENTS

| | | | | |
|---|---|---|---|---|
| DE | 29521148 | U1 * | 9/1996 | F41J 13/00 |
| DE | 202005002672 | U1 | 6/2005 | |
| GB | 2242730 | A | 10/1991 | |
| JP | S45-28229 | B | 9/1970 | |
| JP | S54-183903 | U | 12/1979 | |
| JP | S58-045748 | U | 3/1983 | |
| JP | S60-135326 | U | 9/1985 | |
| JP | S62-29610 | A | 2/1987 | |
| JP | S63-12228 | A | 1/1988 | |
| JP | H06-101219 | A | 4/1994 | |
| JP | H08-136194 | A | 5/1996 | |
| JP | 2003-287399 | A | 10/2003 | |
| JP | 2005188894 | A * | 7/2005 | F41J 13/00 |
| JP | 2005-188894 | A | 7/2014 | |
| RU | 2213320 | C1 | 9/2003 | |
| WO | 2004/068060 | A1 | 8/2004 | |

OTHER PUBLICATIONS

James Walker, Elastomer Engineering Guide, p. 8, (c) 2012.*
English machine translation of DE 29521148 U1, Sep. 1996, Spieth.*
English machine translation of JP 2005188894 A.*
Office Action dated Jul. 2, 2015 in corresponding CN Application No. 201380025148.4.
Extended European Search Report dated Oct. 15, 2015 in corresponding EP Application No. 13800626.7.
Office Action dated Mar. 28, 2017 in corresponding RU application No. 2014152021/28(083230).
Office Action issued dated Mar. 6, 2017 in corresponding JP Application No. 2015-515982.

* cited by examiner

LEACHING PROTECTOR FOR OUTDOOR SHOOTING RANGES

CROSS-REFERENCE TO RELATED APPLICATIONS

This application is the U.S. National Phase under 35. U.S.C. § 371 of International Application PCT/SE2013/050638, filed May 31, 2013, which claims priority to Swedish Patent Application No. SE 1250579-8, filed Jun. 4, 2012. The disclosures of the above-described applications are hereby incorporated by reference in their entirety.

TECHNICAL FIELD

The present invention relates to a leaching protector for lead and other contaminants from ammunition or stopping material at outdoor shooting ranges. The leaching protector is provided with a new covering layer arrangement.

BACKGROUND OF THE INVENTION

During practice and competition shooting with powder-propelled projectiles at shooting ranges, the shots are aimed at target areas e.g. in the shape of ring-marked square targets or figure-like targets of various sizes and shapes. Behind the targets there is generally a projectile arresting arrangement.

The outdoor type arresting arrangement generally consists of ground masses or gravel being dozed into an elongated bank, or as an alternative, the arrester is a natural slope. The extension of the arrester is determined by the target area, and beyond that, by the regulated safety distances for the type of fire arms used and the manner of shooting. To avoid ricochets from the arresting material in e.g. arresting banks, these are supplemented by projectile-arresting material on the section being shot at. Such a material is carefully selected for the type of shooting and will arrest the projectiles and keep them inside the layer.

This type of projectile arrester has the drawback that the material is unprotected against precipitation, leading to large amounts of unwanted lead and other contaminants from ammunition or stopping material being leached by water and spread in an uncontrolled manner into the surrounding environment. There are environmental demands for limiting these lead emissions, and imperative legislation concerning measures for cleansing of lead from shooting bank. A further problem is the freezing of the projectile-arresting material under extremely cold conditions, caused by large amounts of bound water. This limits the use for safety reasons.

U.S. Pat. No. 5,799,948 (A) discloses a leaching protector which tries to overcome these problems. The leaching protector has on the top surface an elastic layer which, after the passage of the projectile, exhibits a very small entry hole. The projectile is subsequently arrested in the projectile-arresting material beneath it. This material in turn is contained in an enclosed space, having a bottom and sides consisting of a watertight layer, with the projectile-arresting material as a distance material, and with said top surface layer as a water-repelling cover. The enclosed space is drained by a drainage system. This means that surface water which has penetrated the elastic top layer via the minute projectile entry holes, or in other ways, is taken care of by drainage that occurs via the projectile-arresting material down to the bottom layer, where the water due to the inclination flows down to the lowermost point, where the drainage water is filtered to separate the projectile-arresting material from the drainage water, and subsequently the water is collected in a drain pipe, which in turn brings the drainage water by e.g. a closed pipe conduit to an enclosed reservoir or to a filtration plant.

The problem with the leaching protector disclosed in U.S. Pat. No. 5,799,948 (A) is that most of the projectiles penetrate the same area of the covering layer and the rest of the covering layer only receives occasional shots. When a part of the covering layer has received too many holes and patches, a new layer of same material is attached by gluing, and when the patched surfaces become too large, the whole covering layer must be changed. This is due to the fact that when there are large holes in the covering layer rain water enters easily, which increases the volume of unwanted leachate. It is uneconomical to change the whole elastic layer, when only a part of it is damaged. There is thus a need for an improved elastic layer removing the above mentioned disadvantage.

SUMMARY

The object of the present invention is to provide a leaching protector having a covering layer arrangement where the previously mentioned problems are avoided. This object is achieved by the features of the characterising portion of claim 1, namely that the covering layer arrangement comprises a security layer covering a security area having a low probability of being penetrated by projectiles, and a firing layer covering a firing area having a high probability of being penetrated by projectiles, wherein the security layer and the firing layer are penetrable by projectiles, the security layer and the firing layer are separate layers, and wherein the security layer is made of a first material and wherein the firing layer is made of a second material.

The firing area may be the area receiving the majority of the fired projectiles. For instance the firing area may be the area receiving more than 90-95% of all fired projectiles depending of type of shooting and weapons. The security area may be the area which receives the rest of the fired projectiles.

The advantage with this covering layer arrangement is that the firing layer is made of a material which is suitable when the layer is penetrated frequently by projectiles and that the security layer is made of another material which is suitable when the layer is only rarely penetrated by projectiles. This has the effect that the firing layer and the security layer can be changed separately. The security layer may be formulated to be resilient to outdoor conditions and can therefore be changed more rarely than the firing layer, which saves costs and material. Since the security layer will only be exposed to a limited number of penetrations, it can be made in a more durable material, which resists wind, snow, UV-rays, Ozone and other loads better.

Further advantages are achieved by implementing one or several of the features of the dependent claims. The covering layer arrangement may comprise a first support element, a second support element and a third support element, wherein an upper edge of the security layer is connected to the first support element, a lower edge of the firing layer is connected to the second support element, and an upper edge of the firing layer and a lower edge of the security layer are connected to the third support element.

The advantage with this covering layer arrangement is that the firing layer and the security layer can be connected to each other and stretched between the support elements so that they make one plane surface.

According to a further advantageous feature of the invention the covering layer arrangement may comprise at least one support strap having a first end and a second end, which support strap is connected in the first end to the first support element and in the second end to the third support element. The advantage with this covering layer arrangement is that the third support element and the firing layer are supported by the at least one support strap. This is especially advantageous when the firing layer is exposed to snow or other heavy loads and also for supporting the firing layer at installation and exchange.

According to a further advantageous feature of the invention the firing layer may be made of an elastic material such that it exhibits a very small entry hole after penetration. E.g. at projectile diameter up to 12 mm and with point tip, the hole is not visible. Multiple shots at the same aiming point may cause the material to break up and show holes big enough to let water seep into the stopping material. Other types like "Hollow-Point" and "Flat-Nose" make bigger holes and are not recommended because of increased service. The advantage with this covering layer arrangement is that by providing e.g. an elastic material which makes the entry holes as small as possible, rain water is prohibited to flow into the leaching protector through the many holes, which minimises leaching of projectile material.

According to a further advantageous feature of the invention the security layer may be made of an elastic material having a high tensile strength and a high durability. The advantage with this covering layer arrangement is that since this layer is only rarely penetrated, the layer doesn't have to be changed so often, in comparison to the firing layer. By optimising the security layer to have a high tensile strength and a high durability, the security layer is able to withstand time, weather, UV, Ozone and loads.

According to yet a further advantageous feature of the invention the first support element and/or the second support element and/or the third support element may be essentially horizontal. The advantage with this covering layer arrangement is that the covering layer arrangement can be constructed easily. It is also easy to stretch the two layers evenly and to predict loads affecting the layers.

According to yet a further advantageous feature of the invention the upper edge of the firing layer and a lower edge of the security layer are overlapping in a joint area. The advantage with this covering layer arrangement is that there will be no gap between the firing layer and the security layer, which means that rain water is prohibited from entering and that stopped tracers will not get air enough to feed a fire.

BRIEF DESCRIPTION OF THE DRAWINGS

The present invention will now be described in detail with reference to the figures, wherein.

DETAILED DESCRIPTION

Figure 1:
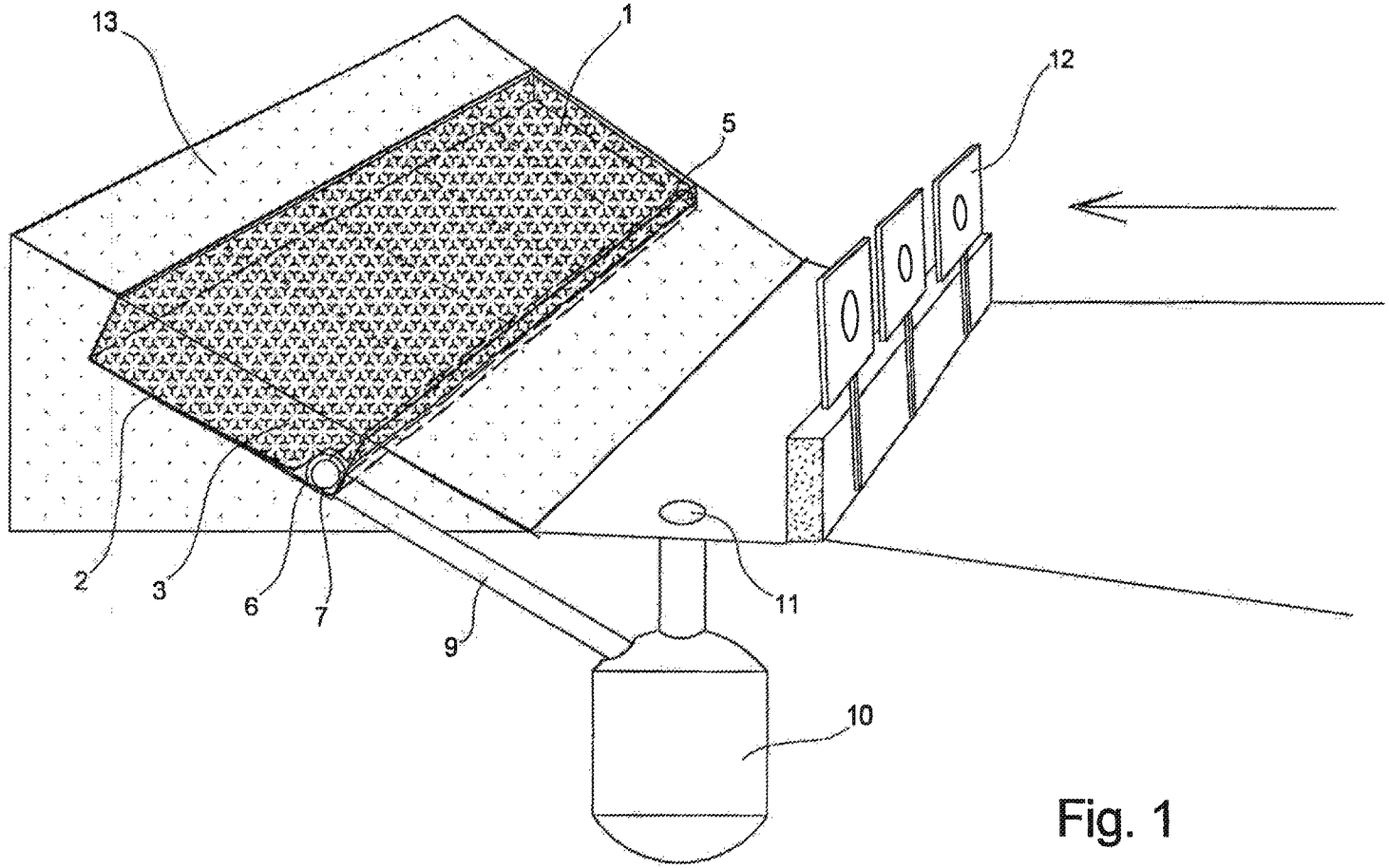
Fig. 1 (Prior Art)
FIG. 1 shows a schematic perspective view of a leaching protector according to the state of the art.
Figure 3:
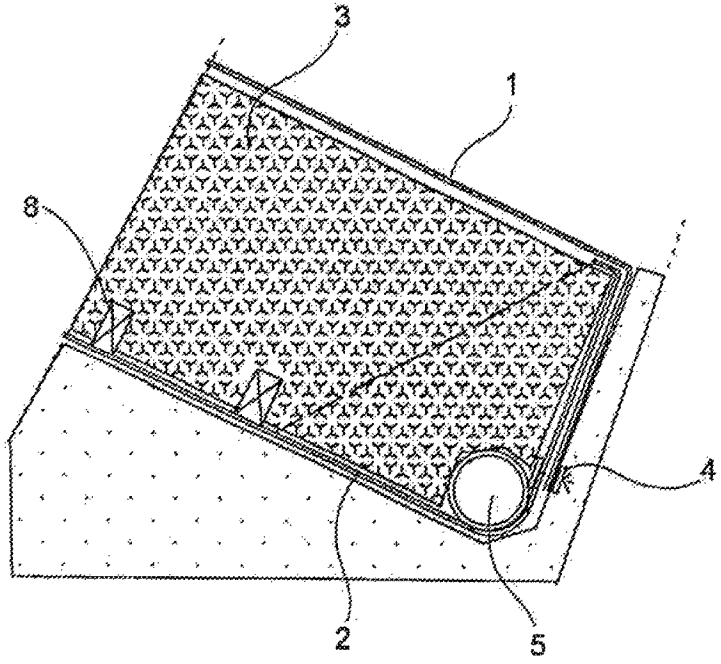
Fig. 3 (Prior Art)
FIG. 3 shows a schematic partial sectional view of the lower part of the leaching protector according to the state of the art.
Figure 2:
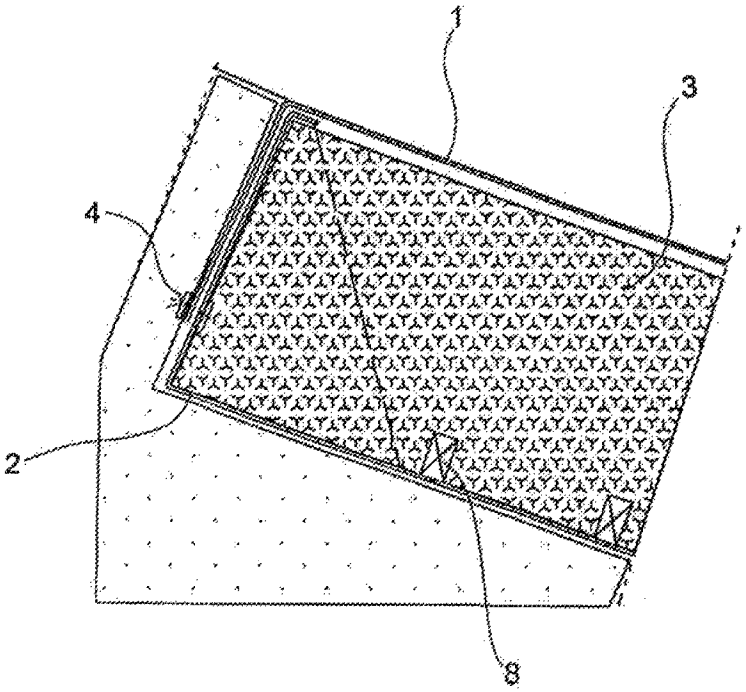
Fig. 2 (Prior Art)
FIG. 2 shows a schematic partial sectional view of the upper part of the leaching protector according to the state of the art.

FIGS. 1-3 show a leaching protector according to the state of the art showed in U.S. Pat. No. 5,799,948 (A).

A covering layer 1, made of rubber, fastened to a backing layer 2 with upturned sides, made of fibreglass-reinforced polyester resin, by means of fastening devices 4 comprising flat steel bars and screw connections, the flat steel bars sealing the covering layer against the backing layer through suitable tightening of the screw connections. The covering layer 1 rests upon the projectile-arresting material 3, and it is joined together with vulcanised overlapping joints. The terminating ends of the covering layer 1 are, in all directions, fastened to the backing layer 2 by means of said fastening devices 4. At the lowermost end, the covering layer 1 is fastened to a collection gutter formed by the backing layer 2, likewise by means of a fastening device 4.

A backing layer 2 made of fibreglass-reinforced polyester resin, arranged onto an inclined surface of e.g. ground material which has been laid as a bank 13, with an inclination selected a.o, in accordance with the inner friction of the arresting material 3. The backing layer 2 is shaped by forming side walls and upper and lower longitudinal walls into a box-shaped structure, adapted to the selected arresting material and the locational demands applied to the device. Glued-on supports of fibreglass-reinforced polyester may be necessary as a support for the backing layer 2 at the upper and lower walls in case the arresting material layer is thick.

A projectile-arresting material 3, filled into the watertight box formed by the backing layer 2 and having a layer thickness and composition adapted to the type of ammunition used, and to the shooting conditions.

Fastening devices 4, made of corrosion resistant flat steel support elements, pulled together by screw connections, with layers 1 and 2 between them, into a watertight attachment.

A drain pipe 5 of perforated resin, placed at the bottom of the collection gutter formed by the fibreglass reinforced polyester at the lowermost end of the backing layer 2, and connected to a wall outlet 7.

An outlet connector 6 having a suitable dimension for connection to a discharge pipe 9, fitting in a watertight connection to said wall outlet 7.

A plastic resin wall outlet 7, glued to the side wall of the backing layer 2 at the collection gutter.

An anti-slide protector 8 may be necessary, depending on the inclination angle and the selected arresting material, in which case such devices are placed at a suitable angle on the backing layer 2 in the form of glued-in wooden ribs 8, appropriately spaced so as to prevent the selected arresting material 3 from sliding downwards.

A discharge pipe 9, conveying the collected drainage water to the reservoir 10.

A collection reservoir 10 for the drainage water.

A lid 11, sealing tightly and being removable for emptying of the tank. The device is drained from leach water via the sealed resin pipe 9, to be collected in the closed plastic resin reservoir 10 with its lid 11 for emptying and inspection.

In the following description only one embodiment of the invention is shown and described, simply by way of illustration of one mode of carrying out the invention.

Figure 4:
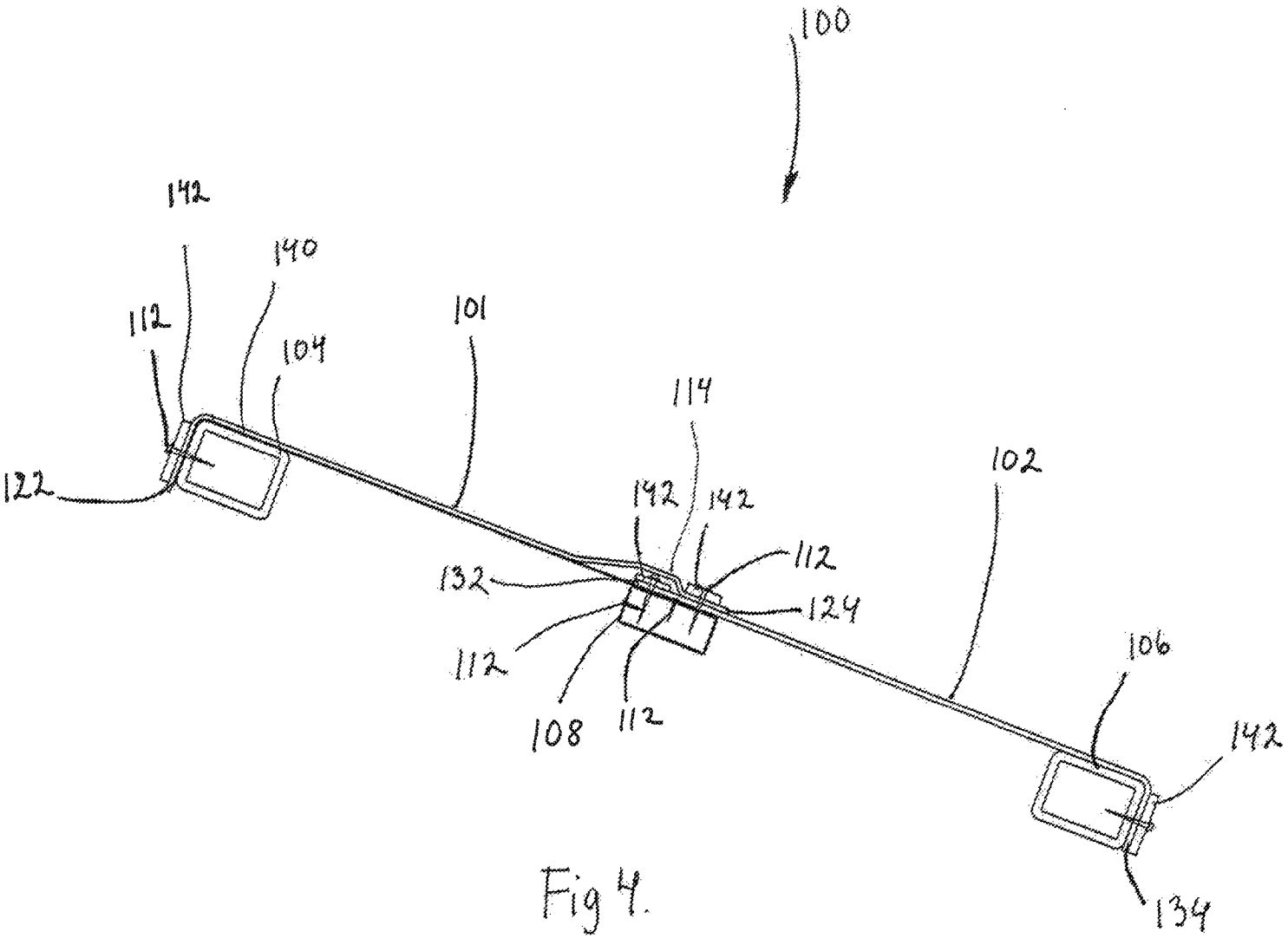
FIG. 4 shows a schematic side view of a covering layer of a leaching protector according to one embodiment of the present invention.

FIG. 4 shows a side view of a covering layer arrangement 100 for a leaching protector according to one embodiment of the present invention. Except for the covering layer arrangement 100, the leaching protector may be constructed in the same way as described in U.S. Pat. No. 5,799,948. According to a further embodiment, the leaching protector of the present invention may be constructed in the same way as described in U.S. Pat. No. 5,799,948, except for the above described outlet connector 6, the plastic resin wall outlet 7, the anti-slide protector 8, the discharge pipe 9, the collection reservoir 10 and the lid 11, described with reference to FIGS. 1-3. Instead, according to the further embodiment (not shown), the drain pipe 5 can be sealed with a lid in each end and a drainage outlet connector can be arranged to the drain pipe 5. The outer free end of the drainage outlet connector can also be sealed with a lid. The drainage water collected in the drain pipe 5 can be discharged via the drainage outlet connector occasionally by removing the lid from the drainage outlet connector and connecting a discharging conduit to the end of the drainage outlet connector for emptying the water. Suitably the length of the drainage outlet connector approximately correspond the depth of the projectile-arresting material 3 such that the lid of the drainage outlet connector can be arranged just below the covering layer 1. Consequently, the upper free end of the drainage outlet connector and the lid can be hidden and the covering layer 1 is only opened occasionally for emptying the drainage water.

Figure 7:
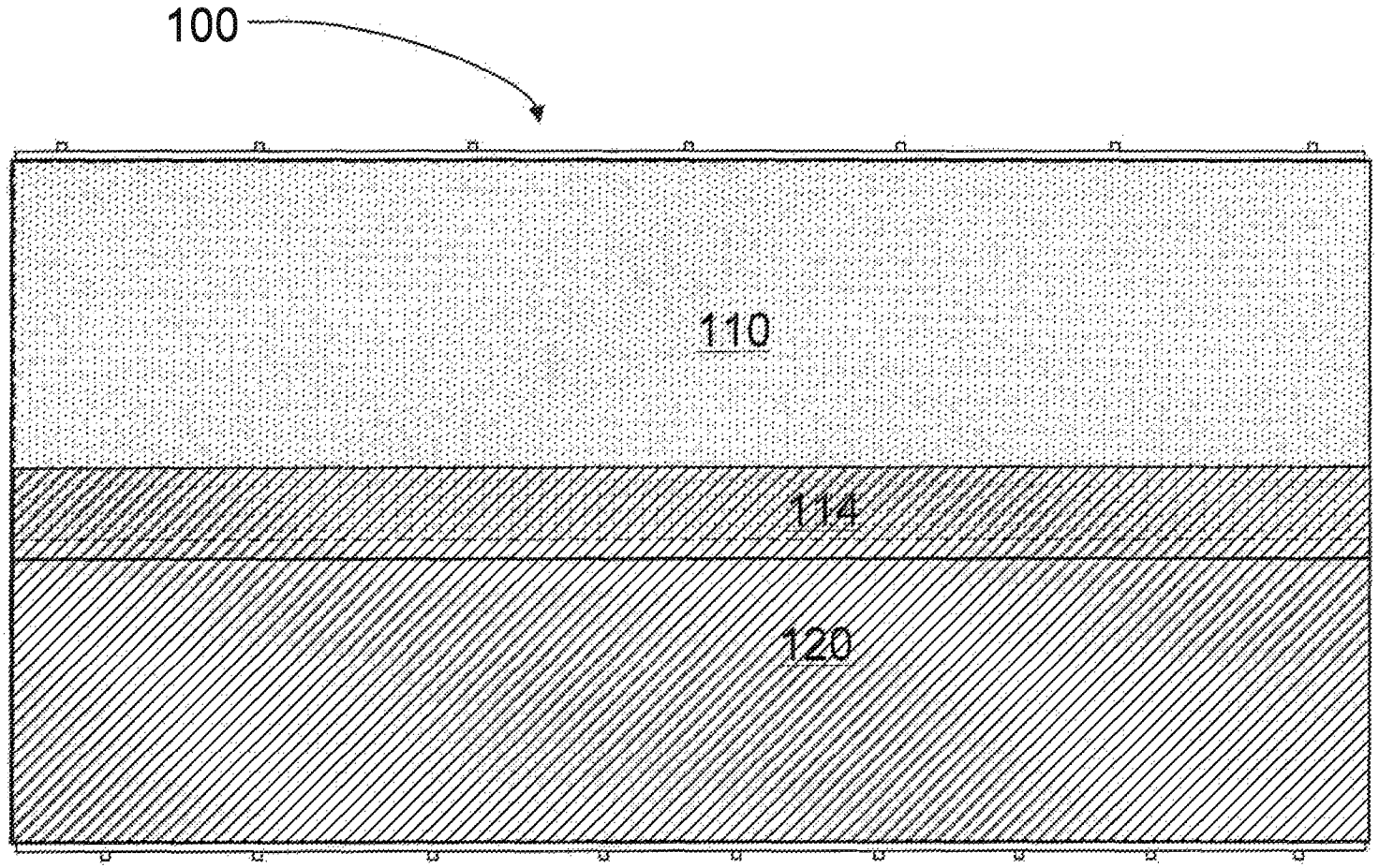
FIG. 7 shows schematically the covering layer arrangement seen obliquely from above illustrating a security area and a firing area.

Further, with reference to FIG. 4, the covering layer arrangement 100 is preferably inclined with approximately 30° with respect to the ground level. The covering layer arrangement 100 comprises a security layer 101 covering a security area 110 and a firing layer 102 covering a firing area 120. The probability of projectiles penetrating the security area 110 is low and the probability of projectiles penetrating the firing area 120 is high. For instance the firing area 120 may be the area receiving more than 90-95% of all fired projectiles and the security area 110 may be the area which receives the rest of the fired projectiles. The security area 110 and the firing area 120 are best seen in FIG. 7. FIG. 7 shows the covering layer arrangement 100 seen obliquely from above. The figure is intended to show the principles of how the covering layer arrangement can be constructed. The measures and the relative sizes of the different parts of the invention are not to scale. For sake of clarity some details are not illustrated in FIG. 7. The security area 110 is shown with dots and the firing area 120 is shown with stripes. The security area 110 and the firing area 120 are overlapping each other in a joint area 114.

Now back to FIG. 4. The security layer 101 is preferably positioned in the upper half of the covering layer arrangement 100 and the firing layer 102 is preferably positioned in the lower half of the covering layer arrangement 100. The security layer 101 can e.g. have a height of 4-6 meters and a width of about 30-80 meters. The firing layer 102 can e.g. have a height of 7 meters and a width of about 30-80 meters. Both the security layer 101 and the firing layer 102 are supported by the projectile arresting material positioned under the layers (not illustrated).

The security layer 101 will not be frequently penetrated and it is optimised to have a high tensile strength and a high durability. It can e.g. be made of reinforced rubber fabric of synthetic rubber or of other elastomers with reinforcing material adapted to resist tensile forces and tearing. The material of the security layer 101 can be made thinner than the material of the firing layer 102 since the number of penetrations is negligible in comparison with the firing layer 102 and the penetrations are more spread which minimises the risk of large holes. The security layer 101 can be made of several smaller pieces of fabrics which are bonded together to form one large fabric. The security layer 101 has an upper edge 122, a lower edge 124 and two side edges 126 and 128 (see FIG. 5). The upper edge 122 of the security layer 101 is attached to a first support element 104 which extends along the upper edge of the security layer 101. The security layer 101 can e.g. be attached to the first support element 104 by means of a clamping strip 142 and fastening devices 112 like e.g. screw joints.

The firing layer 102 will be frequently penetrated and is optimised to exhibit a very small entry hole after penetration. The size of a penetration hole after penetration by a projectile may be between 0.0-0.5 mm depending on the size of the projectile. It is undesired to have large penetration holes, since this will permit rain water to enter into the leaching protector. The firing layer 102 can be a fabric made of crude rubber or other elastomers like e.g. polyurethane. The firing layer 102 can be made of several smaller pieces of fabrics which are bonded together to form one large fabric. The firing layer 102 has an upper edge 132, a lower edge 134 and two side edges 136 and 138 (see FIG. 5). The lower edge 134 of the firing layer 102 is attached to a second support element 106 which extends along the lower edge 134 of the firing layer 101. The firing layer 102 can e.g. be attached to the second support element 106 by means of a clamping strip 142 and fastening devices 112 like e.g. screw joints.

The lower edge 124 of the security layer 101 and upper edge 132 of the firing layer 102 are overlapping each other in the joint area 114 and both layers are connected to a third support element 108 which extends along the lower edge of the security layer 101 and the upper edge of the firing layer 102. The third support element can e.g. be a solid high density polyethylene support element. It can also be a tubular support element or a support element made of a penetrable material which does not cause any ricochets. The security layer 101 and the firing layer 102 are connected to the third support element 108 by means of clamping strips 142 and fastening devices 112 like e.g. screw joints. The side edges 126 and 128 of the security layer and the side edges 136, 138 of the firing layer can e.g. be attached with clamping devices to the sides of the leaching protector.

Figure 5:
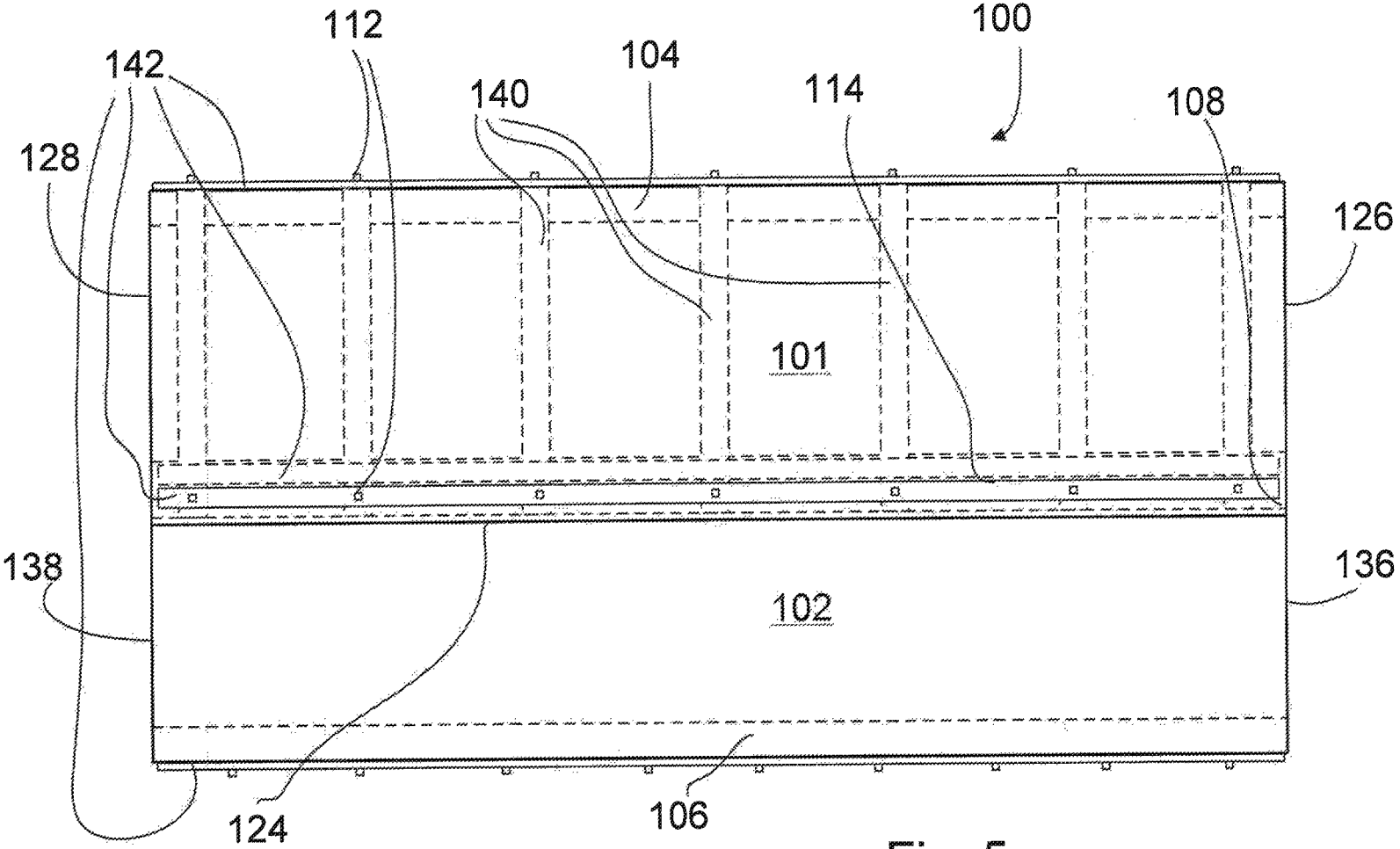
FIG. 5 shows schematically the covering layer arrangement with hidden parts seen obliquely from above.

Although the security layer 101 has a relatively high tensile strength, it must withstand the forces from wind, snow and from the weight of the third support element 108 and the firing layer 102 as well as the tensile forces from the stretching of the layer and from the weight of entering wild animals or humans. Since it is difficult to combine the high tensile strength and elastic properties of the security layer 101 in order to minimise the penetration holes, support straps 140 are provided as illustrated in FIG. 5. The support straps are arranged under the security layer 101, so that the support straps 140 are covered by the security layer 101. The upper end of the support straps are connected to the first support element 104 by means of fastening devices 112. The lower end of the support straps 140 may be winded round the third support element 108 and are attached to the third support element 108 by means of fastening means 112. The support straps 140 can have a width of e.g. 50 mm and they can be arranged with an interval of e.g. 1 meter. They can e.g. be woven and/or be made of polypropylene. They are preferably arranged to handle penetrations without breaking. The support straps 140 are adapted to carry the load of the third support element 108 and of the firing layer 102 alone during the mounting procedure. When the security layer 101 is mounted, the security layer 101 helps carrying the permanent load from e.g. snow and wind and also the stress from the firing layer.

Figure 6:
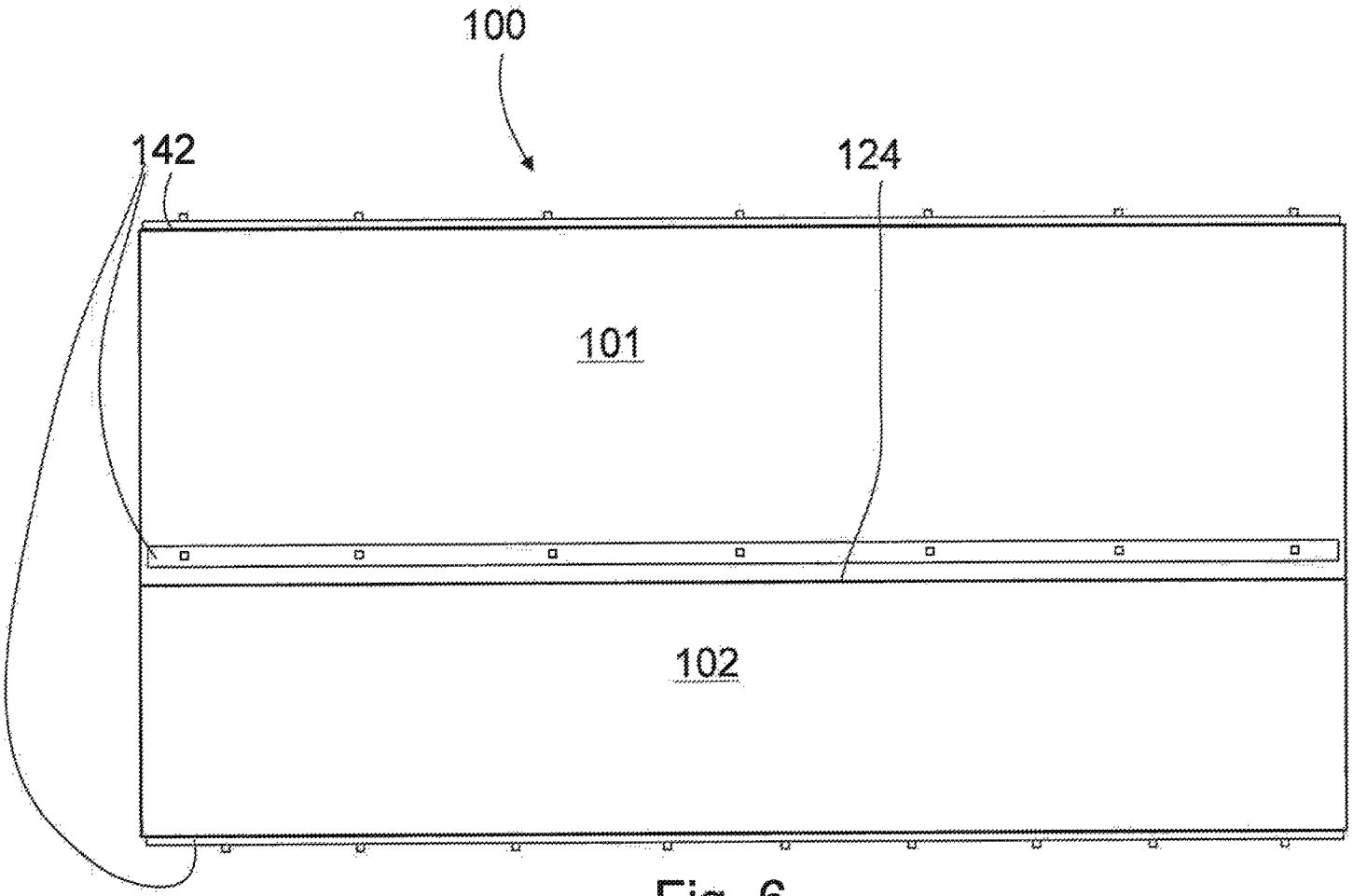
FIG. 6 shows schematically the covering layer arrangement seen obliquely from above.

FIG. 5 shows schematically the covering layer arrangement 100 seen obliquely from above. The parts of the covering layer arrangement 100, which are hidden by the security layer 101 or by the firing layer 102, are shown with dashed lines. The figure is intended to show the principles of how the covering layer arrangement can be constructed. The measures and the relative sizes of the different parts of the invention are not to scale. FIG. 6 shows the covering layer arrangement 100, depicted in the same view as in FIG. 5, but without the hidden parts. FIG. 7 shows the covering layer arrangement 100, depicted in the same view as in FIG. 5 or 6, but aims at illustrating the support area 110 and the firing area 120.

Reference signs mentioned in the claims should not be seen as limiting the extent of the matter protected by the claims, and their sole function is to make claims easier to understand.

As will be realised, the invention is capable of modification in various obvious respects, all without departing from the scope of the appended claims. Accordingly, the drawings and the description thereto are to be regarded as illustrative in nature, and not restrictive.

What is claimed is:

1. A leaching protector at outdoor shooting ranges, the leaching protector comprising:

an elastic covering layer, a projectile-arresting material positioned under the covering layer, wherein the covering layer rests upon the projectile-arresting material, and a drainage, wherein the elastic covering layer comprises:

a security layer adapted to cover an area having a low probability of receiving fired projectiles, the security layer having an upper edge and a lower edge, a firing layer adapted to cover an area having a high probability of receiving fired projectiles, the firing layer having an upper edge and a lower edge, a first support element comprising a first support surface, a second support surface, and a first edge, the first support surface connected to the second support surface by the first edge, the upper edge of the security layer connected to the first support element with a first clamping strip and a first fastener passing through the first clamping strip, the upper edge of the security layer, and the first support element to secure the upper edge of the security layer to the first support element, wherein the first clamping strip covers at least a portion of the upper edge of the security layer to press the portion of the upper edge of the security layer against the first support element via engagement with the first fastener, a second support element comprising a third support surface, a fourth support surface, and a second edge, the third support surface connected to the fourth support surface by the second edge, the lower edge of the firing layer connected to the second support element with a second clamping strip and a second fastener passing through the second clamping strip, the lower edge of the firing layer, and the second support element to secure the lower edge of the firing layer to the second support element, wherein the second clamping strip covers at least a portion of the lower edge of the firing layer to press the portion of the lower edge of the firing layer against the second support element via engagement with the second fastener, and a third support element comprising a fifth support surface perpendicular to the first and third support surfaces and parallel to the second and fourth support surfaces, the upper edge of the firing layer extending over and in direct contact with the fifth support surface and connected to the fifth support surface with a third clamping strip and a third fastener passing through the third clamping strip, the upper edge of the firing layer, and the fifth support surface, the lower edge of the security layer extending over and in direct contact with the upper edge of the firing layer and connected to the third support element with a fourth clamping strip and a fourth fastener passing through the fourth clamping strip, the lower edge of the security layer, the upper edge of the firing layer, and the fifth support surface, the lower edge of the security layer extending over the third clamping strip and the third fastener, wherein the lower edge of the security layer overlaps the upper edge of the firing layer on the fifth support surface of the third support element, wherein the security layer and the firing layer are penetrable by projectiles, and the security layer and the firing layer are separate layers, wherein the security layer is positioned in an upper-half of the covering layer and made of a first elastic material and the firing layer is positioned in a lower half of the covering layer and made of a second elastic material which is different from the first elastic material, and wherein the first elastic material has higher tensile strength and durability than the second elastic material.

2. The leaching protector according to claim 1, wherein the elastic covering layer further comprises at least one support strap, wherein the at least one support strap is connected by a first end thereof to the first support element and by a second end thereof to the third support element.

3. The leaching protector according to claim 2, wherein the at least one support strap is connected to the first support element by the first clamping strip and the first fastener, and the support strap is connected to the third support element by at least one of the third or fourth fasteners.

4. The leaching protector according to claim 2, wherein the at least one support strap is woven and/or is made of polypropylene.

5. The leaching protector according to claim 1, wherein the second material is made of an elastic material such that the firing layer exhibits a very small entry hole after penetration of a projectile.

6. The leaching protector according to claim 5, wherein the second material is made of rubber or other elastomers.

7. The leaching protector according to claim 5, wherein the second material is made of polyurethane.

8. The leaching protector according to claim 1, wherein the first elastic material is made of reinforced rubber fabric of synthetic rubber or of other elastomers with reinforcing material to resist tensile forces and tearing.

9. The leaching protector according to claim 1, wherein the security layer and the firing layer are disposed without any gap therebetween to make a single planar surface.

10. The leaching protector according to claim 1, wherein the upper edge of the firing layer and the lower edge of the security layer are connected to the third support element on the fifth support surface of the third support element without extending over other sides of the third support element.

11. The leaching protector according to claim 1, wherein the first, second, third, and fourth clamping strips extend in parallel with respect to each other over the security and firing layers and secured to the first, second, and third support elements via a plurality of first, second, third, and fourth fasteners.

12. A method for preventing contamination from ammunitions at shooting range, the method comprising:

disposing a covering layer onto an inclined surface, the covering layer comprising a security layer and a firing layer, the security layer made of a first elastic material and the firing layer made of a second elastic material different from the first elastic material, positioning the security layer in an upper half of the covering layer over a first support element and a third support element, covering a non-target area of the inclined surface with the security layer made of the first elastic material, positioning the firing layer in a lower half of the covering layer over a second support element and the third support element, and covering a target area of the inclined surface with the firing layer made of the second elastic material, wherein the security layer and the firing layer are penetrable by projectiles, and the security layer and the firing layer are separate layers, wherein the entire security layer is configured to be removed as a single layer, and the entire firing layer is configured to be removed as a single layer, wherein the first support element comprises a first support surface, a second support surface, and a first edge, the first support surface connected to the second support surface by the first edge, an upper edge of the security layer connected to the first support element with a first clamping strip and a first fastener passing through the first clamping strip, the upper edge of the security layer, and the first support element to secure the upper edge of the security layer to the first support element, wherein the first clamping strip covers at least a portion of the upper edge of the security layer to press the portion of the upper edge of the security layer against the first support element via engagement with the first fastener, wherein the second support element comprising a third support surface, a fourth support surface, and a second edge, the third support surface connected to the fourth support surface by the second edge, a lower edge of the firing layer connected to the second support element with a second clamping strip and a second fastener passing through the second clamping strip, the lower edge of the firing layer, and the second support element to secure the lower edge of the firing layer to the second support element, wherein the second clamping strip covers at least a portion of the lower edge of the firing layer to press the portion of the lower edge of the firing layer against the second support element via engagement with the second fastener, wherein the third support element comprising a fifth support surface perpendicular to the first and third support surfaces and parallel to the second and fourth support surfaces, wherein an upper edge of the firing layer extends over and in direct contact with the fifth support surface and connected to the fifth support surface with a third clamping strip and a third fastener passing through the third clamping strip, the upper edge of the firing layer, and the fifth support surface, wherein a lower edge of the security layer extends over and in direct contact with the upper edge of the firing layer and connected to the third support element with a fourth clamping strip and a fourth fastener passing through the fourth clamping strip, the lower edge of the security layer, the upper edge of the firing layer, and the fifth support surface, the lower edge of the security layer extending over the third clamping strip and the third fastener, and wherein the lower edge of the security layer overlaps the upper edge of the firing layer on the fifth support surface of the third support element.

13. The method according to claim 12, further comprising providing projectile arresting material under the covering layer.

14. The method according to claim 12, wherein the inclined surface inclines approximately 30° with respect to a ground level.

15. The method according to claim 14, further comprising stretching the security layer and the firing layer between at least two of the first, second, and third support elements to make a single planar surface.

16. The method according to claim 12, wherein the second elastic material is made of an elastic material such that the firing layer exhibits a very small entry hole after penetration of a projectile.

17. The method according to claim 16, wherein the second elastic material is made of rubber or other elastomers.

18. The method according to claim 12, wherein the first elastic material is made of reinforced rubber fabric of synthetic rubber or of other elastomers with reinforcing material to resist tensile forces and tearing.

19. A leaching protector at outdoor shooting ranges, the leaching protector comprising:

an elastic covering layer, a projectile-arresting material positioned under the covering layer, wherein the covering layer rests upon the projectile-arresting material, and a drainage, wherein the elastic covering layer comprises:

a security layer adapted to cover an area having a low probability of receiving fired projectiles, the security layer having an upper edge and a lower edge, a firing layer adapted to cover an area having a high probability of receiving fired projectiles, the security layer having an upper edge and a lower edge, a first support element comprising a first support surface, a second support surface, and a first edge, the first support surface connected to the second support surface by the first edge, the upper edge of the security layer connected to the first support element with a first clamping strip and a first fastener passing through the first clamping strip, the upper edge of the security layer, and the first support element to secure the upper edge of the security layer to the first support element, wherein the first clamping strip covers at least a portion of the upper edge of the security layer to press the portion of the upper edge of the security layer against the first support element via engagement with the first fastener, a second support element comprising a third support surface, a fourth support surface, and a second edge, the third support surface connected to the fourth support surface by the second edge, the lower edge of the firing layer connected to the second support element with a second clamping strip and a second fastener passing through the second clamping strip, the lower edge of the firing layer, and the second support element to secure the lower edge of the firing layer to the second support element, wherein the second clamping strip covers at least a portion of the lower edge of the firing layer to press the portion of the lower edge of the firing layer against the second support element via engagement with the second fastener, and a third support element comprising a fifth support surface perpendicular to the first and third support surfaces and parallel to the second and fourth support surfaces, the upper edge of the firing layer extending over the fifth support surface and connected to the fifth support surface with a third clamping strip and a third fastener passing through the third clamping strip, the upper edge of the firing layer, and the fifth support surface, the lower edge of the security layer extending over the fifth support surface and connected to the third support element with a fourth clamping strip and a fourth fastener passing through the fourth clamping strip, the lower edge of the security layer, and the fifth support surface, wherein the lower edge of the security layer and the upper edge of the firing layer overlap with each other on the fifth support surface of the third support element, wherein the security layer and the firing layer are penetrable by projectiles, and the security layer and the firing layer are separate layers, wherein the security layer is positioned in an upper-half of the covering layer and made of a first elastic material and the firing layer is positioned in a lower half of the covering layer and made of a second elastic material which is different from the first elastic material, and wherein the first elastic material has higher tensile strength and durability than the second elastic material.

20. The leaching protector according to claim 19, wherein the upper edge of the security layer is connected to the first support element on the first support surface with the first clamping strip and the first fastener passing through the first clamping strip, and wherein the upper edge of the security layer directly contacts the second support surface and extends over the second support surface and the first edge to the first support surface.

21. The leaching protector according to claim 20, wherein the lower edge of the firing layer is connected to the second support element on the third support surface with the second clamping strip and the second fastener passing through the second clamping strip, wherein the lower edge of the firing layer directly contacts the fourth support surface and extends over the fourth support surface and the second edge to the third support surface, and wherein the first support surface of the first support element faces away from the third support surface of the second support element such that the first and second fasteners extend toward each other through the first and third support surfaces, respectively.

* * * * *